US006395687B1

(12) United States Patent
Hanejko

(10) Patent No.: US 6,395,687 B1
(45) Date of Patent: May 28, 2002

(54) METHOD OF LUBRICATING A DIE CAVITY AND METHOD OF MAKING METAL-BASED COMPONENTS USING AN EXTERNAL LUBRICANT

(75) Inventor: Francis G. Hanejko, Marlton, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 0 days.

(21) Appl. No.: 09/866,013

(22) Filed: May 24, 2001

Related U.S. Application Data

(60) Provisional application No. 60/208,175, filed on May 31, 2000.

(51) Int. Cl.[7] ..... B22F 1/00; C10M 149/18

(52) U.S. Cl. ..... 508/243; 508/454; 508/551; 508/554; 419/61; 419/66; 72/42

(58) Field of Search ..... 508/243; 419/61, 419/66

(56) References Cited

U.S. PATENT DOCUMENTS

| | | | | |
|---|---|---|---|---|
| 4,834,800 A | | 5/1989 | Semel | 106/403 |
| 4,999,157 A | | 3/1991 | Nishio et al. | 419/68 |
| 5,108,493 A | | 4/1992 | Causton | 75/255 |
| 5,154,881 A | | 10/1992 | Rutz et al. | 419/37 |
| 5,256,185 A | | 10/1993 | Semel et al. | 75/255 |
| 5,330,792 A | | 7/1994 | Johnson et al. | 427/217 |
| 5,368,630 A | | 11/1994 | Luk | 75/252 |
| 5,429,792 A | * | 7/1995 | Luk | 419/36 |
| 5,484,469 A | | 1/1996 | Rutz et al. | 75/252 |
| 5,498,276 A | | 3/1996 | Luk | 75/252 |
| 5,518,639 A | | 5/1996 | Luk et al. | 252/29 |
| 5,538,684 A | | 7/1996 | Luk et al. | 419/66 |
| 5,624,631 A | | 4/1997 | Luk | 419/23 |
| 5,682,591 A | * | 10/1997 | Inculet et al. | 419/38 |
| 5,744,433 A | | 4/1998 | Storstrom et al. | 508/454 |
| 5,782,954 A | | 7/1998 | Luk | 75/252 |
| 6,039,784 A | | 3/2000 | Luk | 75/231 |
| 6,203,753 B1 | | 3/2001 | Donaldson | 419/54 |
| 6,231,635 B1 | * | 5/2001 | Suzuki et al. | 75/252 |
| 6,229,690 B1 | * | 10/2001 | Mongeon et al. | 118/622 |

* cited by examiner

*Primary Examiner*—Ellen M. McAvoy
(74) *Attorney, Agent, or Firm*—Woodcock Washburn LLP

(57) ABSTRACT

A method is provided for lubricating a die cavity that includes applying a lubricant composition containing a high melting point polymeric wax lubricant to the wall of a die cavity. Preferably, the lubricant is a polyamide lubricant that has a melting temperature greater than the temperature of the die wall during use. The present invention also provides a method of making a compacted metal part that includes applying the lubricant composition to an internal wall of a die cavity, introducing a metal-based powder composition into the die cavity; and compacting the powder composition at a pressure sufficient to form a compacted part from the metal powder composition.

14 Claims, 5 Drawing Sheets

METHOD OF LUBRICATING A DIE CAVITY AND METHOD OF MAKING METAL-BASED COMPONENTS USING AN EXTERNAL LUBRICANT

This application claims the benefit of U.S. Provisional Application No. 60/208,175 filed May 31, 2000.

FIELD OF THE INVENTION

The present invention relates to a method of lubricating a die cavity using an external lubricant composition, and a method of making metal components using the external lubricant composition. The methods of the present invention are particularly useful for compacting metal-based powders where the die is heated during use.

BACKGROUND OF THE INVENTION

The powder metallurgy industry has developed metal-based powder compositions that can be processed into integral metal parts having various shapes and sizes for uses in the automotive and electronics industries. One processing technique for producing the parts from the metal-based powders is to charge the powder into a die cavity and compact the powder under pressure. The resultant green part is then removed from the die cavity and sintered.

To avoid excessive wear on the die cavity, lubricants are commonly used during the compaction process. Lubrication is generally accomplished by either blending a solid lubricant powder with the metal-based powder (internal lubrication) or by spraying a liquid dispersion or solution of the lubricant onto the die cavity surface (external lubrication). In some cases, both lubrication techniques are utilized.

An example of an internal lubricant is disclosed for example in U.S. Pat. No. 5,154,881. The '881 patent discloses the use of an internal amide lubricant that is the reaction product of a monocarboxylic acid, a dicarboxylic acid, and a diamine. This amide lubricant is particularly useful when compacting metal-based powders at elevated temperatures.

Despite the advantages of using internal lubricants, there are disadvantages. For example, the lubricant generally has a density of about 1–2 (g/cm$^3$, as compared to the density of the metal-based powder, which is about 7–8 g/cm$^3$. Inclusion of the less dense lubricant in the composition lowers the green density of the compacted part. Also, internal lubricants are generally not sufficiently effective for reducing the ejection pressures when manufacturing parts having part heights (the minimum distance between the opposing punches in the press) in excess of about 1–2 in. (2.5–5 cm). Additionally, when the particles of internal lubricant burn off during sintering, pore spaces can be left in the compacted part, providing a source of weakness for the part.

The use of external, die wall lubricants has generally taken the form of liquid dispersions of the solid lubricant. U.S. Pat. No. 5,518,639 discloses the use of an external lubricant composition that includes a solid lubricant, a binder for the solid lubricant and a solvent for the binder. Despite the advantages of the lubricant composition disclosed in the '639 patent, it is desire to provide alternative lubricant compositions.

According to the present invention, there is provided an external lubricant composition that is particularly useful for compacting metal-based powder compositions where it is desired to carry out the compaction at elevated temperatures.

SUMMARY OF THE INVENTION

The present invention provides a method of lubricating a wall of a die cavity that includes applying a lubricant composition to the die wall, where the lubricant composition contains at least one high melting point polymeric wax lubricant, that is preferably a polyamide lubricant. Preferably, the polyamide lubricant has a melting point range that begins at a temperature greater than the temperature of the die wall.

The present invention also provides a method of making a compacted metal part, that includes applying the aforementioned lubricant composition to a wall of a die cavity, introducing a metal-based powder composition into the die cavity; and compacting the powder composition at a pressure sufficient to form a compacted part from the metal powder composition.

A preferred polyamide lubricant useful in the present invention is a reaction product of about 10–30 weight percent of a $C_6$–$C_{12}$ linear dicarboxylic acid, about 10–30 weight percent of a $C_{10}$–$C_{22}$ monocarboxylic acid, and about 40–80 weight percent of a diamine having the formula $(CH_2)_x(NH_2)_2$ where x is 2–6.

DETAILED DESCRIPTION OF THE INVENTION

Figure 1:
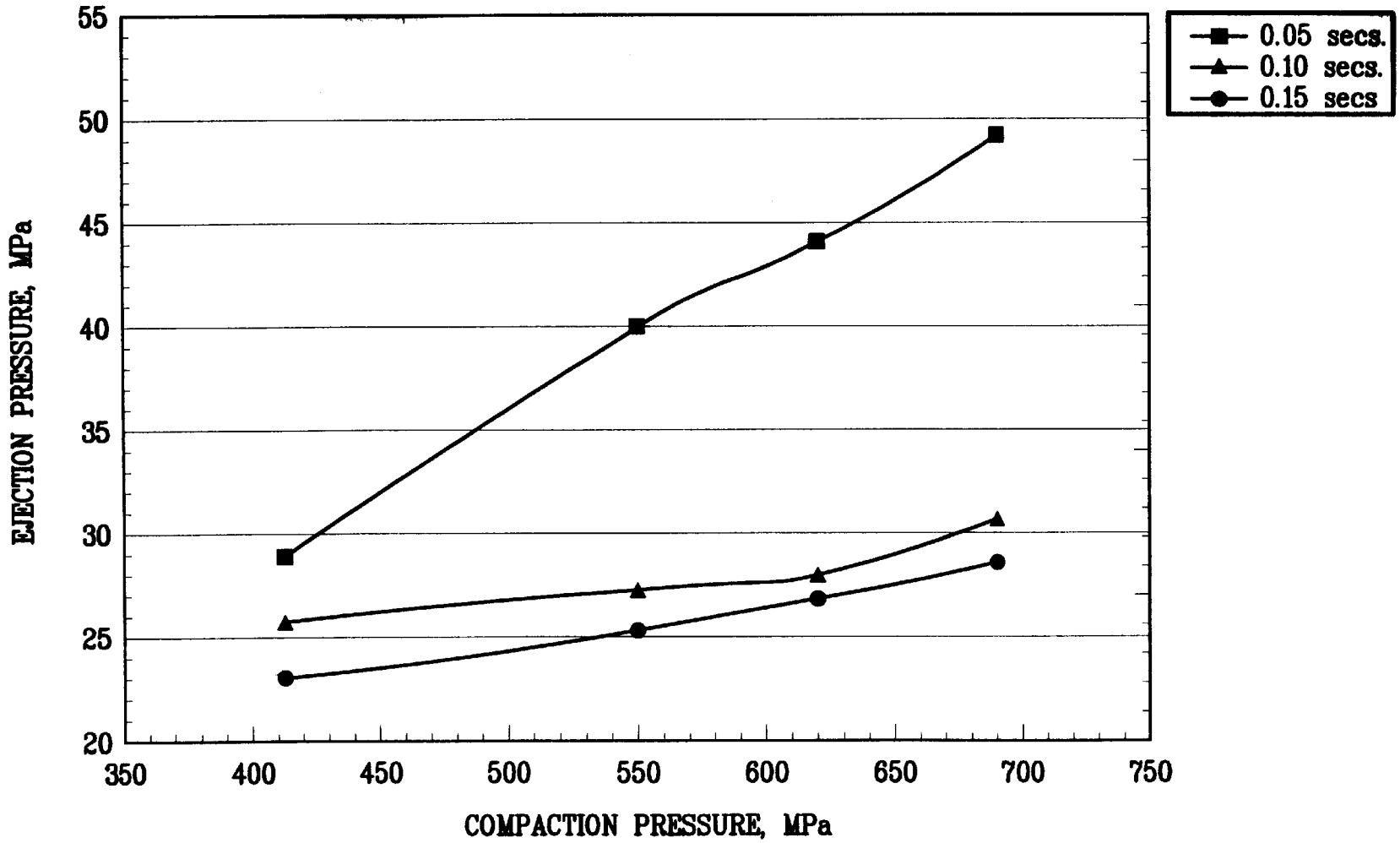
FIG. 1 is a graph showing ejection pressure, in units of MPa, versus compaction pressure, in units of MPa, for compacting a metal-based powder composition using an external lubricant composition containing 100 wt % PROMOLD™ 450 (a polyamide lubricant). The ejection pressure versus compaction pressure is shown at spray times of 0.05 seconds, 0.10 seconds, and 0.15 seconds for the external lubricant composition.

The present invention provides lubricant compositions containing a solid high melting point polymeric wax lubricant, preferably designed for use in the powder metallurgy industry. The lubricant composition is generally applied to the walls of a compaction die before the powder composition is charged into the die for subsequent compaction into a metallurgical part. The lubricant composition prevents die scoring during compaction, and reduces the stripping and sliding pressures upon the ejection of the compacted part. The lubricant composition of the present invention can negate the need to supply an internal lubricant, which is blended into the powder composition prior to compaction, and thereby eliminates the problems of reduced density in the final compacted parts that can be caused by use of internal lubricants.

In one embodiment of the present invention, a method is provided for lubricating an internal wall of a die cavity that includes applying a lubricant composition containing a high melting point polymeric wax lubricant. By "high melting point" it is meant a wax having a melting point range beginning at a temperature greater than about 100° C., more preferably greater than about 120° C., and most preferably greater than about 150° C. The high melting point polymeric wax lubricant also preferably has a weight average particle size of less than about 100 μm, more preferably less than about 50 μm, an most preferably less than 30 microns. Moreover, it is generally preferred that about 90 weight percent of the particles be below about 30 microns, preferably below about 20 microns, and more preferably below about 15 microns. The polymeric wax lubricant is preferably present in the lubricant composition in an amount of from about 10 weight percent to 100 weight percent, more preferably from about 40 weight percent to 100 weight percent, and most preferably from about 50 weight percent to about 100 weight percent.

A preferred high melting point polymeric wax lubricant is a solid polyamide lubricant. In one embodiment of the present invention, the polyamide lubricant is preferably a condensation product of a dicarboxylic acid, a monocarboxylic acid, and a diamine, such as those described in U.S. Pat. Nos. 5,154,881 and 5,368,630, the disclosures of which are hereby incorporated by reference in their entireties.

In such an embodiment the dicarboxylic acid is preferably a linear acid having the general formula HOOC(R)COOH where R is a saturated or unsaturated linear aliphatic chain of 4–10, preferably about 6–8, carbon atoms. Preferably, the dicarboxylic acid is a $C_8$–$C_{10}$ saturated acid. Sebacic acid is a preferred dicarboxylic acid. The dicarboxylic acid is present in an amount of from about 10 to about 30 weight percent of the starting reactant materials.

The monocarboxylic acid is preferably a saturated or unsaturated $C_{10}$–$C_{22}$ fatty acid. Preferably, the monocarboxylic acid is a $C_{12}$–$C_{20}$ saturated acid. Stearic acid is a preferred saturated monocarboxylic acid. A preferred unsaturated monocarboxylic acid is oleic acid. The monocarboxylic acid is present in an amount of from about 10 to about 30 weight percent of the starting reactant materials.

The diamine preferably has the general formula $(CH_2)_x(NH_2)_2$ where x is an integer of about 2–6. Ethylene diamine is the preferred diamine. The diamine is present in an amount of from about 40 to about 80 weight percent of the starting reactant materials.

The condensation reaction is preferably conducted at a temperature of from about 260°–280° C. and at a pressure up to about 7 atmospheres. The reaction is allowed to proceed to completion, usually not longer than about 6 hours. The polyamide is preferably produced under an inert atmosphere such as nitrogen. The reaction is preferably carried out in the presence of a catalyst such as 0.1 weight percent methyl acetate and 0.001 weight percent zinc powder. The lubricants formed by the above condensation reaction are polyamides characterized as having a melting range rather than a melting point. As those skilled in the art will recognize, the reaction product is generally a mixture of moieties of varying molecular weights, and therefore properties dependent on such, will vary. As a whole, this polyamide lubricant preferably begins to melt at a temperature between about 150° C. (300° F.) and 260° C. (500° F.), and more preferably between about 200° C. (400° F.) to about 260° C. (500° F.). The polyamide will generally be fully melted at a temperature about 250° C. above this initial melting temperature, although it is preferred that the polyamide reaction product melt over a range of no more than about 100° C.

A preferred such polyamide lubricant is commercially available as ADVAWAX™ 450, or PROMOLD™ 450, polyamide sold by Morton International of Cincinnati, Ohio, which is an ethylene bis-stearamide having an initial melting point between about 200° C. and 300° C.

In another embodiment of the present invention the polyamide is an oligomer of a polyamide as described in for example U.S. Pat. No. , 5,744,433 ("'433 patent"), the disclosure of which is hereby incorporated by reference in its entirety. The polyamide oligomers described in the '433 patent include lactams containing the repeating unit:

$$[NH—(CH_2)_m—CO]_n—$$

where m is in the range of from about 5 to about 11, and n is in the range of from about 5 to about 50.

The polyamides in the '433 patent also include oligomers formed from diamines and dicarboxylic acids to contain the following repeating unit:

$$—[NH—(CH_2)_m—NCO(CH_2)_n—CO]_x—$$

where m and n are in the range of from about 4 to about 12, where the sum of m and n is greater than about 12, and where x ranges from about 2 to about 25.

These oligomers preferably have a weight average molecular weight of less than about 30,000 and a melting point ranging beginning at about 100° C. to about 220° C. Moreover, one skilled in the art will recognize that the aforementioned oligomers may be terminated with various functional groups, such as those terminal groups described in the '433 patent.

Specific examples of the oligomers of polyanides useful in the present invention include Orgasol™ 3501, Orgasol™ 2001, and Orgasol™ 2002 supplied by Elf Atochem of France.

In addition to the high melting point polymeric wax lubricant, such as the polyamide lubricant, the lubricant composition can also optionally contain other high melting point solid lubricants, such as inorganic lubricants. For example, graphite, molybdenum disulfide ($MoS_2$), boron nitride, or combinations thereof may be present in the lubricant composition. The weight average particle size of the optional solid lubricant is preferably below about 20 microns, more preferably below about 10 microns, and most preferably below about 7 microns. Also, it is generally preferred that about 90 weight percent of the particles be below about 20 microns, preferably below about 15 microns, and more preferably below about 10 microns. Preferably, these optional lubricants are present in the composition in an amount of from 0 weight percent to about 75 weight percent, more preferably from about 1 weight percent to about 60 weight percent, and most preferably from about 5 weight percent to about 50 weight percent.

Other optional components in the lubricant composition will depend on, for example, the method of application of the lubricant composition to the die wall. These other optional components will be described in more detail hereinafter.

The lubricant composition useful in the present invention may be applied in various ways to the die cavity. For example, the lubricant composition may be applied as a powder to the die wall or may be dispersed and/or dissolved in a liquid prior to application. Preferably, the lubricant composition is applied as a powder to the wall.

Any method known to those skilled in the art may be used to apply the lubricant composition as a powder to the die wall. Preferably, the method of application results in the die wall being uniformly covered with at least a monolayer of lubricant composition. Preferred application rates are in an amount that lowers the ejection pressure to a suitable value, but does not adversely affect the properties of the component being formed in the die. A preferred method of applying the lubricant composition as a powder uses a powder spray gun that imparts a charge to the powder, that is opposite to the charge of the die wall. A preferred powder spray system is Gasbarre Die Wall Lubrication System available from Gasbarre, located in St. Mary, Pa.

Alternatively, the solid lubricant composition containing the solid polymeric wax lubricant may be dispersed and/or dissolved in a liquid and sprayed onto the die wall using any technique known to those skilled in the art. Preferably, the solid lubricant composition is dispersed in the liquid as opposed to being dissolved. The amount of the lubricant composition sprayed onto the die is generally left to the discretion of the parts manufacturer, however an amount sufficient to uniformly wet the surface of the die cavity should be employed. Examples of liquids include for example water, organic solvents such as aliphatic and aromatic organic solvents, or combinations thereof. Examples of useful solvents include ketones such as acetone; $C_{1-10}$ alcohols such as ethanol, propanol, and isopropanol; $C_{5-10}$ alkanes such as hexane; aromatic alcohols; benzene; cyclohexanone; and mixtures thereof. Preferably, the amount of liquid in the lubricant composition is that amount needed for applying the polymeric wax lubricant uniformly. Typically, the level of liquid will be from about 30 weight percent to about 90 weight percent, and more preferably from about 50 weight percent to about 90 weight percent, based on the total weight of the lubricant composition containing the liquid.

The lubricant composition containing the polymeric wax lubricant may also be applied using the techniques disclosed in U.S. Pat. No. 5,518,639, which is hereby incorporated by reference in its entirety. In this embodiment the solid lubricant composition, containing the polymeric wax lubricant useful in the present invention, may be applied in a composition containing a binder, and a solvent (e.g., the organic solvents previously described) for the binder. Examples of suitable binders include polyethylene glycols having a weight average molecular weight of from about 3000 to about 35,000; polyethylene glycol esters having a weight average molecular weight of from about 500 to about 10,000, where the ester functionality is formed from saturated or unsaturated $C_{12-36}$ fatty acids; partial esters of $C_{3-6}$ polyhydric alcohols where the ester functionality is formed from saturated or unsaturated $C_{12-36}$ fatty acids; polyvinyl esters having a weight average molecular weight of at least about 200, where the ester functionality is formed from saturated or unsaturated $C_{12-36}$ fatty acids; polyvinyl pyrrolidones having a weight average molecular weight of at least about 200; or combinations thereof.

In the above embodiment, the binder is generally present in an amount of from about 1–30, preferably about 1–20, and more preferably about 5–10, weight percent of the total lubricant composition (including the polymeric wax lubricant). The organic solvent constitutes the balance of the composition, and is generally present in an amount of from about 30–90, preferably about 50–90, and more preferably about 55–80, weight percent of the total lubricant composition.

In another embodiment of the present invention, a method is provided for compacting a metal-based component that includes applying the lubricant composition useful in the present invention to an internal wall of a die cavity, introducing a metal-based powder composition into the die cavity after applying the lubricant composition to the wall; and compacting the powder composition at a pressure sufficient to form a compacted part from the metal-based powder composition.

The compaction of metal-based powder composition is accomplished by well known conventional methods. The lubricant composition is applied to the die cavity wall according to the techniques previously described. If a liquid lubricant composition is used, the liquid is preferably allowed to evaporate prior to charging the die with the powder composition. Additionally, the die may be preheated prior to, or after applying the lubricant composition to the die wall, depending upon the type of lubricant composition used. For example, if a powder lubricant composition is used, preferably the die cavity is preheated prior to its application.

Once the die cavity has been coated with the lubricant composition of the present invention, the powder composition is typically fed via a hopper into a portion of a die cavity, the die cavity is then closed, and a pressure is applied to the die. Typical compaction pressures are at least about 5 tsi, up to about 200 tsi, and conventionally from about 40–60 tsi. Additionally, heat may be applied to the die during compaction to enhance the properties of the compacted component. Typical compaction temperatures range from about ambient temperature to about 400° C., and more preferably from about 50° C. to about 250° C., and most preferably from about 50° C. to about 150° C. The die is then opened and the green part is ejected from the die cavity.

The lubricant composition useful in the present invention reduces the ejection pressures of the compacted green part from the die cavity. Additionally, the use of the external lubricant composition permits one to lower the amount of internal lubricant in the metal-based powder composition being compacted, resulting in improved green properties.

The metal-based powder compositions useful in the present invention comprise metal-based particles of the kind generally used in the powder metallurgy industry, such as iron-based powders and nickel-based powders. The metal-based particles constitute a major portion of the metal-based powder composition, and generally constitute at least about 80 weight percent, preferably at least about 85 weight percent, and more preferably at least about 90 weight percent based on the total weight of the metal-based powder composition.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded.

Substantially pure iron powders that can be used in the invention are powders of iron containing not more than about 1.0% by weight, preferably no more than about 0.5% by weight, of normal impurities. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other iron powders that can be used in the invention are typical sponge iron powders, such as Hoeganaes' ANCOR MH-100 powder.

The iron-based powder can incorporate one or more alloying elements that enhance the mechanical or other properties of the final metal part. Such iron-based powders can be powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. Preferred alloying elements arc molybdenum, phosphorus, nickel, silicon or combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders are diffusion-bonded iron-based powders which are particles of substantially pure iron that have a layer or coating of one or more other metals, such as steel-producing elements, diffused into their outer surfaces. Such commercially available powders include DISTALOY 4600A diffusion bonded powder from Hloeganaes Corporation, which contains about 1.8% nickel, about 0.55% molybdenum. and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is of iron pre-alloyed with molybdenum (Mo). The powder is produced by atomizing a melt of substantially pure iron containing from about 0.5 to about 2.5 weight percent Mo. An example of such a powder is Hoeganaes' ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Another example of such a powder is Hoeoanaes' ANCORSTEEL 4600V steel powder, which contains about 0.5–0.6 weight percent molybdenum, about 1.5–2.0 weight percent nickel, and about 0.1–0.25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated by reference in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes' ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders arc commercially available in various grades in the Hoeganaes ANCOR® series, such as the ANCORE® 303L, 304L, 316L, 410L, 430L, 434L, and 409Cb powders.

The iron-based powder have a distribution of particle sizes. Typically, these powders are such that at least about 90%, by weight of the powder sample can pass through a No. 45 sieve (U.S. series), and more preferably at least about 90% by weight of the powder sample can pass through a No. 60 sieve. These powders typically have at least about 50%, by weight of the powder passing through a No. 70 sieve and retained above or larger than a No. 400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve. As such, these powders can have a weight average particle size as small as one micron or below, or up to about 850–1,000 microns, but generally the particles will have a weight average particle size in the range of about 10–500 microns. Preferred are iron-alloy particles or substantially pure iron particles having a maximum weight average particle size up to about 350 microns; more preferably the particles will have a weight average particle size in the range of about 25–150 microns, and most preferably 80–150 microns. Reference is made to MPIF Standard 05 for sieve analysis.

The metal-based particles can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying, powders mentioned previously with respect to the iron-based powders. Examples of nickel-based powders include those commercially available as the Hoeganaes ANCORSPRAY® powders such as the N-70/30 Cu, N-80/20, and N-20 powders.

The metallurgical powder compositions of the present invention may also include any additive commonly used with metallurgical compositions such as alloying powders, binding agents, machining agents, and plasticizers. The types and amounts used of these additives are described in for example U.S. Pat. Nos. 5,368,630; 5,498,276; and 5,782,954; the disclosures of which are hereby incorporated by reference in their entireties.

The metal-based powder composition may also contain an internal lubricant. Examples of typical powder metallurgy internal lubricants include the stearates, such as zinc stearate, lithium stearate, manganese stearate, or calcium stearate; synthetic waxes, such as ethylene bisstearamide or polyolefins; or combinations thereof. The lubricant may also be a polyamide lubricant as previously described herein, particulate ethers disclosed in U.S. Pat. Nos. 5,498,276, and 6,039,784 to Luk, or a metal salt of a fatty acid disclosed in U.S. Pat. No. 5,330,792 to Johnson et al., the disclosures of which are hereby incorporated by reference in their entireties. Preferred lubricants are ethylene bisstcaramide, zinc stearate, Kenolube™ (supplied by Hoganas Corporation, located in Hoganas, Sweden), Orgasol™ oligomers, Ferrolube™ (supplied by Blanchford), and polyethylene wax. The lubricant may also be a combination of any of the aforementioned lubricants described above.

The lubricant is generally added in an amount of from about 0.1 to about 1.5 weight percent, more preferably from about 0.1 to about 1.0 weight percent, and most preferably from about 0.1 to about 0.6 weight percent, of the metallurgical powder composition. Moreover, the level of internal lubricant is preferably lower than what would normally be needed without the use of the external lubricant composition employed in the present invention.

EXAMPLES

Some embodiments of the present invention will now be described in detail in the following Examples. Metal-based powder compositions were compacted using external lubricants useful in the present invention to form metal-based components. The metal-based components were evaluated for green strength, green density, green expansion, and ejection pressure.

Metal-based powder compositions were prepared by admixing Ancorsteel® 85 HP powder, previously described herein, 2.0 wt % nickel powder, 0.6 wt % graphite, and varying amounts of PROMOLD™ 450 as an internal lubricant. The PROMOLD™ 450 was supplied by Morton International of Cincinnati, Ohio, and is an ethylene bisstearamide having, an initial melting point between about 200° C. and 300° C. The nickel powder used was grade Inco 123 having a weight average particle size of −5 μm. supplied by International Nickel Inc. The graphite was Asbury grade 3203 having a weight average particle size of 2 to 6 μm, obtained from Asbury Graphite Mills, Inc., located in Asbury, N.J.

The powder compositions that were prepared arc shown below in Table 1:

TABLE 1

Metal-Based Powder Compositions

| Composition | Ancorsteel ® 85 HP | Ni (wt %) | Graphite (wt %) | PROMOLD ™ 450 (wt %) |
|---|---|---|---|---|
| A | Balance | 2.0 | 0.60 | 0.0 |
| B | Balance | 2.0 | 0.60 | 0.15 |
| C | Balance | 2.0 | 0.60 | 0.30 |
| D | Balance | 2.0 | 0.60 | 0.60 |

External lubricant compositions were also prepared having the compositions shown in Table 2.

TABLE 2

Compositions of Powder External Lubricants

| Composition | Chemtrend (wt %) | Graphite (wt %) | PROMOLD ™ 450 (wt %) |
|---|---|---|---|
| E (comp.) | 100 | 0.0 | 0.0 |
| F | 0.0 | 0.0 | 100 |
| G | 0.0 | 50 | 50 |

The Chemtrend™ die wall lubricant used was Chemtrend™ 101, supplied by Chemtrend, located in Howell, Mich. The graphite and PROMOLD™ 450 was the same as that used for the metal-based powder compositions in Table 1.

The powder compositions shown in Table 1 were compacted in a compaction device at various compaction pressures ranging from 410 MPA to 690 MPA to form test bars in accordance with the following procedure. The die was preheated to 145° C. and the desired powder in Table 1 was preheated to a temperature of 140° C. After preheating the die, the desired external lubricant in Table 2 was charged into a Gasbarre Die Wall Lubrication System supplied by Gasbarre, located in St. Mary, Pa. The lubricant was then sprayed onto the die for a desired spray time at a desired lubricant air pressure and charge gun pressure. Following spraying of the external lubricant, the desired metal-based powder composition in Table 2 was charged into the die and compacted at the desired pressure to form a test bar. Following compaction, the ejection pressure was measured as the test part was ejected from the die. The test bar obtained was then evaluated for various green properties.

The ejection pressure is a quantitative measurement of the ejection force required to start moving the compacted part from the die. The method for determining the ejection pressure is set forth for example, in U.S. Pat. No. 5,154,881, which is hereby incorporated by reference in its entirety.

The test bars were evaluated for green density, green strength, and green expansion. The test methods used for determining green density and green strength were as follows:

| Property | Test Method |
|---|---|
| Green Density | ASTM B331-95 |
| Green Strength | ASTM B312-96 |

Green Expansion was determined according to the following equation:

$$\text{Green Expansion (\%)} = \frac{100[(\text{green bar length}) - (\text{die length})]}{\text{die length}}$$

Example 1

Effect of Spray Time on Ejection Pressure

Composition C in Table 1, containing 0.3 wt % PROMOLD™ Lubricant, was compacted according to the procedure described above at various compaction pressures and at external lubricant spray times ranging from 0.05 seconds to 0.15 seconds to determine the effect of spray time on ejection pressure. The external lubricant was 100 wt % PROMOLD™ 450 (composition F in Table 2). The results are shown in FIG. 1. FIG. 1 is a graph showing the relation of compaction pressure (x-axis, in MPa) and ejection pressure (y-axis, in MPa) at spray times of PROMOLD™ of 0.05 seconds, 0.10 seconds, and 0.15 seconds. FIG. 1 shows that while there is large benefit in reducing ejection pressures by increasing the spray time from 0.05 seconds to 0.10 seconds, there is only a small benefit gained in reduced ejection pressures by increasing the spray time from 0.10 second to 0.15 seconds.

Example 2

Figure 2:
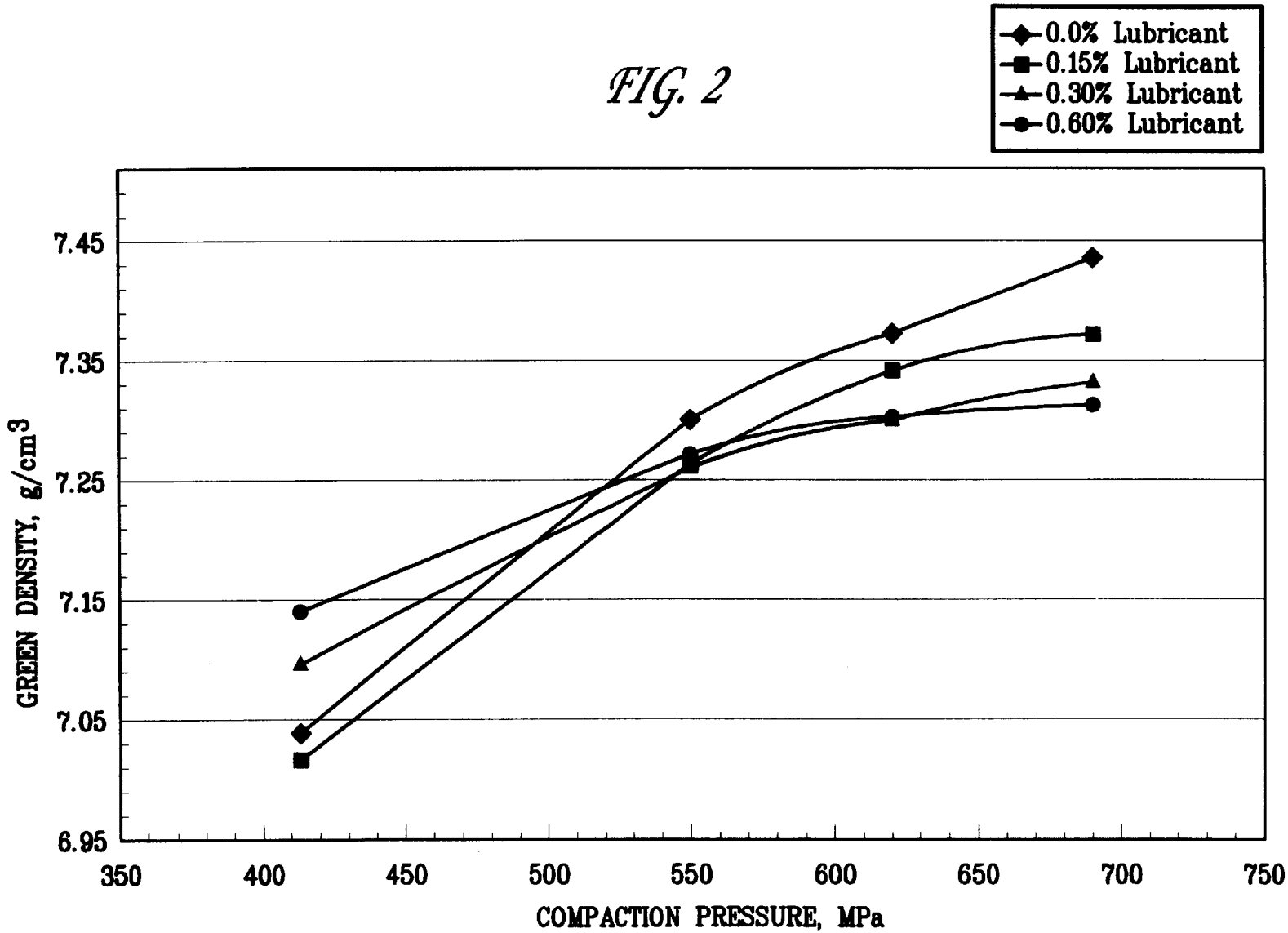
FIG. 2 is a graph showing the effect of green density, in units of g/cm$^3$ , versus compaction pressure, in units of MPa, for four compacted metal-based powder compositions containing 0 wt %, 0.15 wt %, 0.30 wt %, and 0.60 wt % internal lubricant, and using an external lubricant composition containing 100 wt % PROMOLD™ 450 sprayed onto the die for 0.10 seconds.
Figure 3:
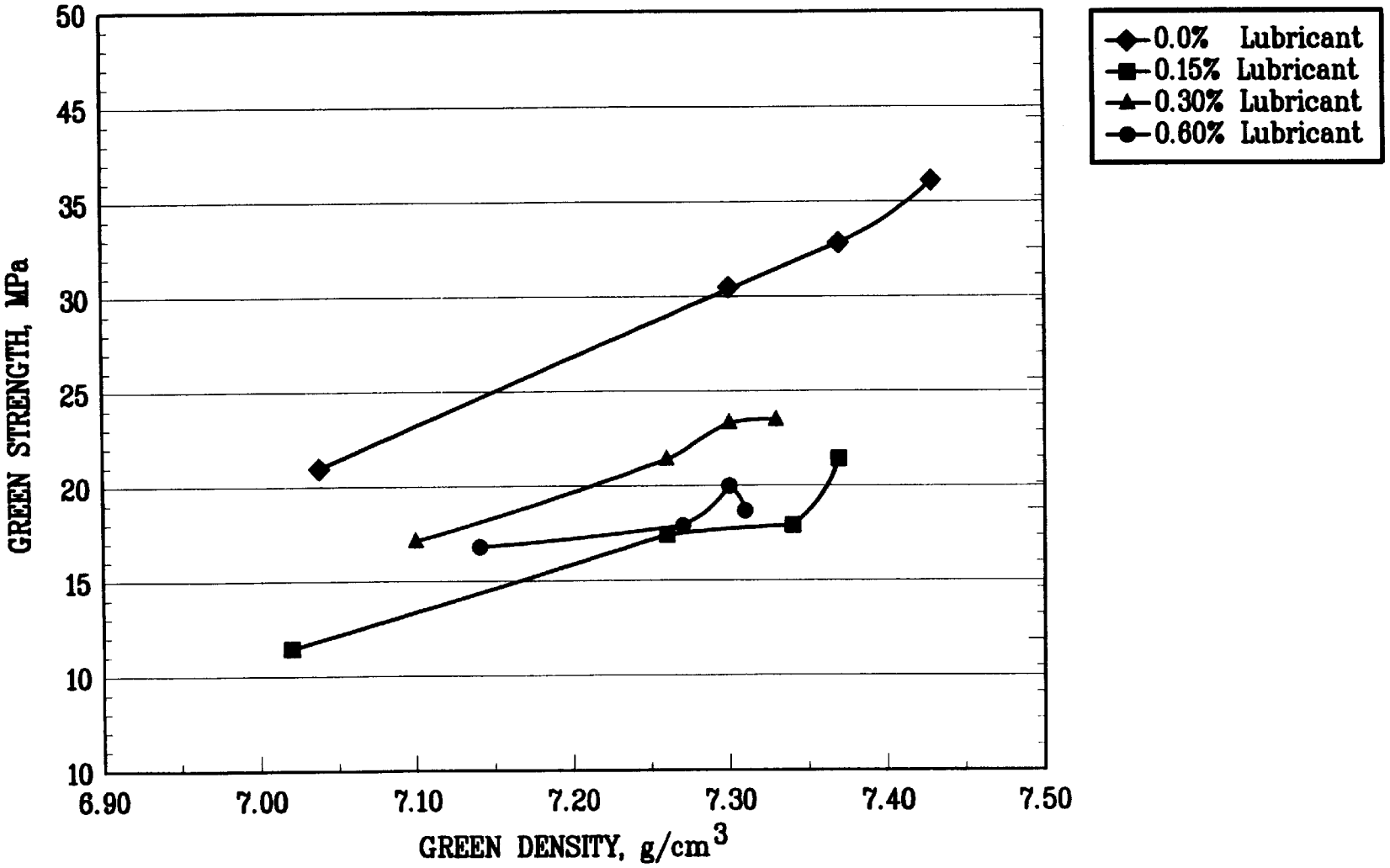
FIG. 3 is a graph showing the effect of green strength, in units of MPa, versus green density, in units of g/cm$^3$, for four compacted metal-based powder compositions containing 0 wt %, 0.15 wt %, 0.30 wt %, and 0.60 wt % internal lubricant, and using an external lubricant composition containing 100 wt % PROMOLD™ 450 sprayed onto the die for 0.10 seconds. The compactions were carried out at pressures from 410 MPa to 685 MPa.
Figure 4:
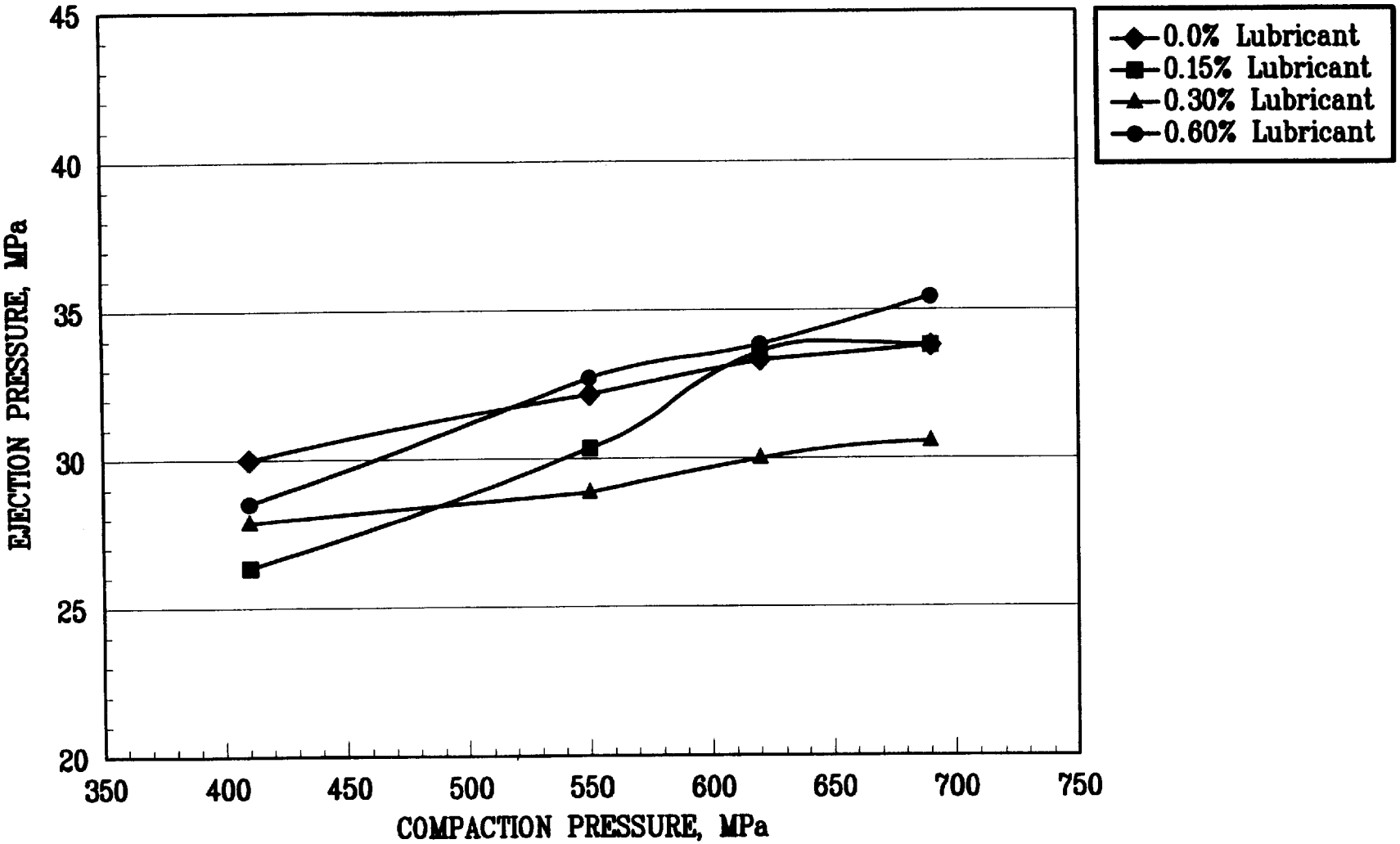
FIG. 4 is a graph showing the effect of ejection pressure, in units of MPa, versus compaction pressure, in units of MPa, for four compacted metal-based powder compositions containing 0 wt %, 0.15 wt %, 0.30 wt %, and 0.60 wt % internal lubricant, and using an external lubricant composition containing 100 wt % PROMOLD™ 450 sprayed onto the die for 0.10 seconds.
Figure 5:
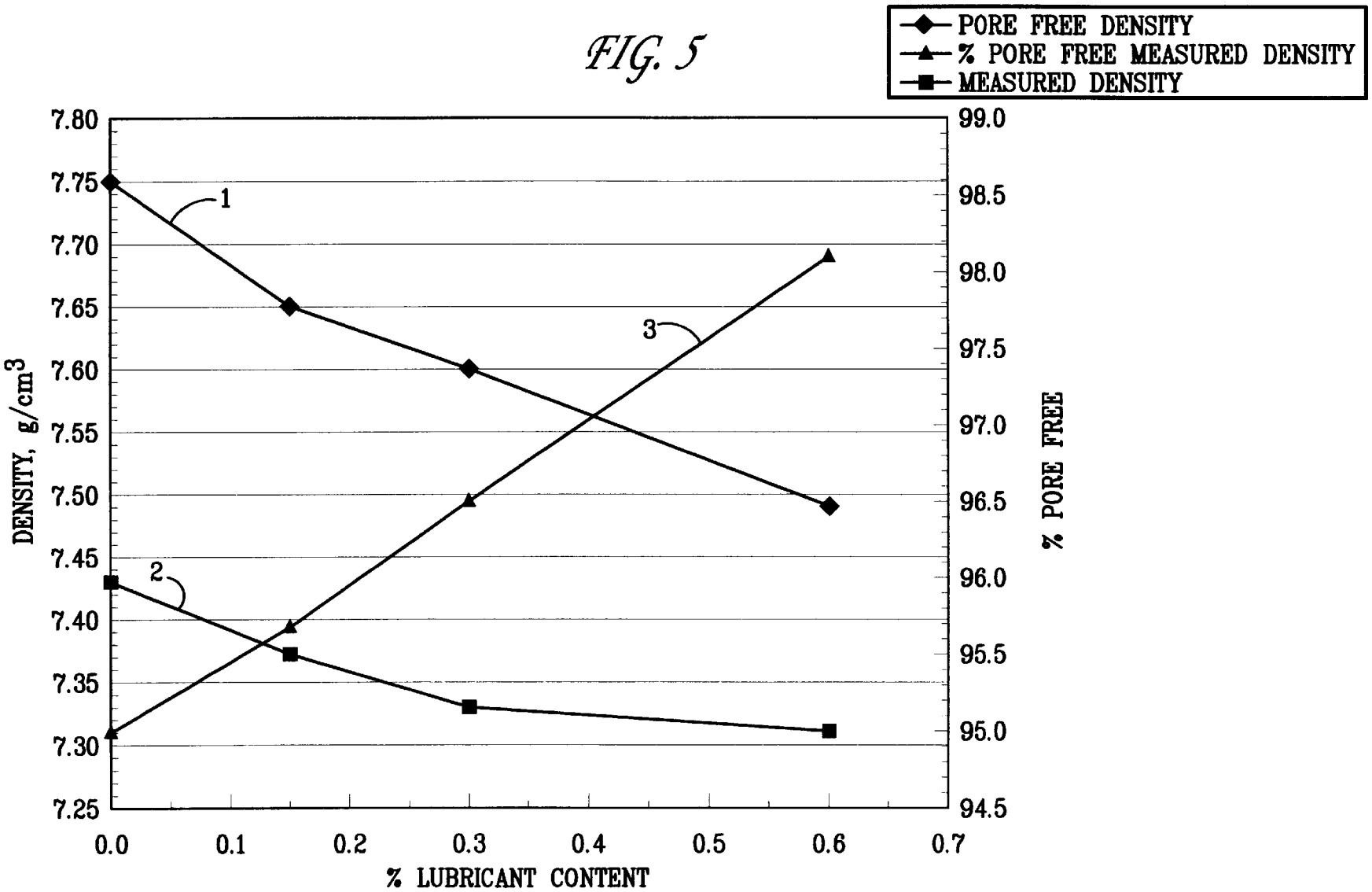
FIG. 5 is a graph showing the effect of (a) pore free density, in units of g/cm$^3$, (line 1), (b) measured density, in units of g/cm$^3$, (line 2), and (c) % pore free density (line 3) versus internal lubricant content in compacted metal-based powder compositions. An external lubricant composition containing 100 wt % PROMOLD™ 450 was sprayed onto the die for 0.10 seconds prior to compaction.

Effect of Green Properties and Ejection Pressures in Varying the Internal Lubricant Level Compositions A through D were compacted at pressures ranging from 410 MPa (30 tsi) to 685 MPa (50 tsi) according to the above procedure to determine the effect of the level of internal lubricant on green properties and ejection pressure. The spray time for the external lubricant in all cases was 0.10 seconds and the external lubricant was PROMOLD™ 450 (composition F in Table 2). The effect on green properties and ejection pressure by varying the level of internal lubricant are shown in FIGS. 2 to 5. FIG. 2 is a graph showing the effect of green density (in g/cm$^3$) versus compaction pressure (in MPa) for Compositions A through D in Table 1. FIG. 3 is a graph showing the effect of green strength (in MPa) versus green density (in g/cm$^3$) for Compositions A through D in Table 1 at various compaction pressures ranging from 410 MPa to 685 MPa. FIG. 4 is a graph showing the effect of ejection pressure (in MPa) versus compaction pressure (in MPa) for Compositions A through D. FIG. 5 is a graph showing the effect of (a) pore free density, (in g/cm$^3$, line 1), (b) measured density, (in g/cm$^3$, line 2), and (c) % pore free density (line 3) for Compositions A through D in Table 1 (plotted on the x-axis as % lubricant content). The data in FIG. 5 is shown at a compaction pressure of 685 MPa. These Examples demonstrate the effectiveness of the external lubricant composition useful in the present invention.

Examples 3 to 8

Effect of Other External lubricants on Green Properties and Ejection Pressures

External lubricants having the compositions described as Composition E (comparative) and G in Table 2 were evaluated by compacting the metal-based powder compositions B to D shown in Table 1. The procedure for spraying the external lubricant and compacting the metal-based powder was the same general procedure as described above. The green properties and ejection pressures obtained for test bars produced are shown in Table 3. For all examples in Table 3 the compaction pressure was 545 MPa (40 tsi). The spray time was varied in some examples and is shown in Table 3.

TABLE 3

Green Properties of Compacted Metal-Based Powder Compositions

| Example | Metal-Based Powder | Ext. Lub. | Spray Time (sec) | Ejec. Press (MPa) | Green Density (g/cm$^3$) | Green Strength MPa | % Green Exp. |
|---|---|---|---|---|---|---|---|
| Comp. 3 | D | E | 0.0 | 35 | 7.31 | 24 | 0.33 |
| Comp. 4 | D | E | 0.10 | 32 | 7.27 | 17 | 0.36 |
| Comp. 5 | D | E | 0.15 | 30 | 7.24 | 15 | 0.40 |
| 6 | D | G | 0.10 | 27 | 7.28 | 17 | 0.32 |
| 7 | C | G | 0.10 | 40 | 7.27 | 18 | 0.25 |
| 8 | B | G | 0.10 | 50 | 7.23 | 21 | 0.25 |

The above data shows that the external lubricant composition useful in the present invention permits the use of lower levels of internal lubricant to improve green properties. For Comparative Examples 3 through 5, the green properties became worse as more external lubricant was applied to the die wall due to the external lubricant melting on the die wall.

What is claimed is:

1. A method of making a metal based compacted component comprising the steps of:

(a) providing a metallurgical powder composition comprising at least about 85 percent of a metal-based powder;

(b) providing an external lubricant composition, wherein the external lubricant composition comprises at least about 10 percent by weight, based on total weight of the external lubricant composition, of high melting point polymeric wax lubricant having a melting point range beginning, at a temperature greater than about 100 degrees Centigrade;

(c) applying the external lubricant composition to interior walls of a compaction die in an amount sufficient to reduce the stripping and sliding pressures upon ejection of a metal based component; and (d) compacting the metallurgical powder composition in the die at a compaction pressure sufficient to form a metal component.

2. The method of claim 1 wherein the high melting point polymeric wax lubricant comprises (a) an amide lubricant that is the reaction product of:

(i) about 10–30 weight percent, based on total weight of the lubricant composition, of a $C_6$–$C_{12}$ linear dicarboxylic acid having the formula HOOC(R) COOH where R is a saturated or unsaturated linear alphatic chain of 4 to 10 carbon atoms;

(ii) about 10–30 weight percent, based on total weight of the lubricant composition, of a saturated or unsaturated $C_{10}$–$C_{22}$ monocarboxylic acid, and (iii) about 40–80 weight percent, based on total weight of the lubricant composition, of a diamine having the formula $(CH_2)_x(NH_2)_2$ wherein x is an integer from about 2 to about 6;

(b) oligomers of a polyamide; or (c) combinations thereof.

3. The method of claim 2 wherein the monocarboxylic acid is stearic acid, the dicarboxylic acid is sebacic acid, and the diamine is ethylene diamine.

4. The method of claim 2 wherein the oligomers comprise:

(a) lactams having the formula:

$$-[NH-(CH_2)_m-CO]_n-$$

wherein m is an integer from about 5 to about 11, and n is an integer form about 5 to about 50; or (b) oligomers formed from diamines and dicarboxylic acids having the formula:

$$-[NH-(CH_2)_m-NCO(CH_2)_n-CO]_x-$$

wherein m is an integer from about 4 to about 12, n is an integer from about 4 to about 12, the sum of m and n is greater than 12, and x is an integer from about 2 to about 25.

5. The method of claim 1 wherein the external lubricant composition has a weight average particle size of less than about 20 $\mu$m.

6. The method of claim 1 wherein the external lubricant composition comprises at least about 40 percent by weight of high melting point polymeric wax lubricant comprising:

(a) an amide lubricant that is the reaction product of:

(i) about 10–30 weight percent, based on total weight of the lubricant composition, of a $C_6$–$C_{12}$ linear dicarboxylic acid having the formula HOOC(R) COOH where R is a saturated or unsaturated linear alphatic chain of 4 to 10 carbon atoms;

(ii) about 10–30 weight percent, based on total weight of the lubricant composition, of a saturated or unsaturated $C_{10}$–$C_{22}$ monocarboxylic acid, and (iii) about 40–80 weight percent, based on total weight of the lubricant composition, of a diamine having the formula $(CH_2)_x(NH_2)_2$ wherein x is an integer from about 2 to about 6;

(b) oligomers of a polyamide; or (c) combinations thereof.

7. A method of making a metal based compacted component comprising the steps of:

(a) providing a metallurgical powder composition comprising at least about 85 percent of a metal-based powder;

(b) providing an external lubricant composition, wherein the external lubricant composition comprises at least about 40 percent by weight, based on total weight of the external lubricant composition, of high melting point polymeric wax lubricant having a melting point range beginning at a temperature greater than about 100 degrees Centigrade;

(c) applying the external lubricant composition to interior walls of a compaction die in an amount sufficient to reduce the stripping and sliding pressures upon rejection of a metal based component; and (d) compacting the metallurgical powder composition in the die at a compaction pressure sufficient to form a metal component.

8. The method of claim 7 wherein the high melting point polymeric wax lubricant comprises (a) an amide lubricant that is the reaction product of:

(i) about 10–30 weight percent, based on total weight of the lubricant composition, of a $C_6$–$C_{12}$ linear dicarboxylic acid having the formula HOOC(R) COOH where R is a saturated or unsaturated linear alphatic chain of 4 to 10 carbon atoms;

(ii) about 10–30 weight percent, based on total weight of the lubricant composition, of a saturated or unsaturated $C_{10}$–$C_{22}$ monocarboxylic acid, and (iii) about 40–80 weight percent, based on total weight of the lubricant composition, of a diamine having the formula $(CH_2)_x(NH_2)_2$ wherein x is an integer from about 2 to about 6;

(b) oligomers of a polyamide; or (c) combinations thereof.

9. The method of claim 8 wherein the monocarboxylic acid is stearic acid, the dicarboxylic acid is sebacic acid, and the diamine is ethylene diamine.

10. The method of claim 8 wherein the oligomers comprise:

(a) lactams having the formula:

$$-[NH-(CH_2)_m-CO]_n-$$

wherein m is an integer from about 5 to about 11, and n is an integer form about 5 to about 50; or (b) oligomers formed from diamines and dicarboxylic acids having the formula:

$$-[NH-(CH_2)_m-NCO(CH_2)_n-CO]_x-$$

wherein m is an integer from about 4 to about 12, n is an integer from about 4 to about 12, the sum of m and n is greater than 12, and x is an integer from about 2 to about 25.

11. The method of claim 7 wherein the high melting, point polymeric wax lubricant has a weight average particle size of less than about 20 $\mu$m.

12. The method of claim 7 wherein the metal-based powder is an iron-based powder.

13. The method of claim 7 wherein the external lubricant composition comprises at least about 50 percent by weight of high melting point polymeric wax lubricant comprising:

(a) an amide lubricant that is the reaction product of:

(i) about 10–30 weight percent, based on total weight of the lubricant composition, of a $C_6$–$C_{12}$ linear dicarboxylic acid having the formula HOOC(R) COOH where R is a saturated or unsaturated linear alphatic chain of 4 to 10 carbon atoms;

(ii) about 10–30 weight percent, based on total weight of the lubricant composition, of a saturated or unsaturated $C_{10}$–$C_{22}$ monocarboxylic acid, and (iii) about 40–80 weight percent, based on total weight of the lubricant composition, of a diamine having the formula $(CH_2)_x(NH_2)$, wherein x is an integer from about 2 to about 6;

(b) oligomers of a polyamide; or (c) combinations thereof.

14. The method of claim 13 wherein the metal-based powder is an iron-based powder.

* * * * *

UNITED STATES PATENT AND TRADEMARK OFFICE

CERTIFICATE OF CORRECTION

PATENT NO. : 6,395,687 B1
DATED : May 28, 2002
INVENTOR(S) : Francis G. Hanejko

It is certified that error appears in the above-identified patent and that said Letters Patent is hereby corrected as shown below:

Column 1,
Line 62, "desire" should read -- desired --

Column 4,
Line 46, "polyanides" should read -- polyamides --

Column 7,
Line 30, "arc" should read -- are --
Line 43, "Hloeganes" should read -- Hoeganaes --
Line 57, "Hoeoanaes" should read -- Hoeganaes --

Column 9,
Line 12, "bisstcaramide" should read -- bisstearamide --

Column 14,
Line 10, "form" should read -- from --

Signed and Sealed this

First Day of October, 2002

*Attest:*

*Attesting Officer*

JAMES E. ROGAN
*Director of the United States Patent and Trademark Office*